US006098321A

United States Patent [19]

Logan

[11] Patent Number: 6,098,321

[45] Date of Patent: Aug. 8, 2000

[54] BUCKET CONVERTER FOR AN EXCAVATION BUCKET

[76] Inventor: John Duncan Logan, P.O. Box 392, Seward, Ak. 99664

[21] Appl. No.: 09/306,540

[22] Filed: May 7, 1999

[51] Int. Cl.[7] ..... E02F 3/76

[52] U.S. Cl. ..... 37/409; 37/403; 37/903

[58] Field of Search ..... 414/724, 912; 37/446, 468, 444, 450, 403, 404, 408, 409, 466, 903; 172/772, 773, 701.3

[56] References Cited

U.S. PATENT DOCUMENTS

| | | |
|---|---|---|
| 3,034,237 | 5/1962 | Wolfe et al. . |
| 3,092,920 | 6/1963 | Benno . |
| 3,362,554 | 1/1968 | Fortier . |
| 3,767,070 | 10/1973 | Arnold . |
| 3,854,608 | 12/1974 | Arnold . |
| 3,938,680 | 2/1976 | Grimes . |
| 4,009,529 | 3/1977 | Johnson . |
| 4,051,614 | 10/1977 | Diggs . |
| 4,208,814 | 6/1980 | Stone . |
| 4,566,844 | 1/1986 | Campin . |
| 4,704,811 | 11/1987 | Jefferson . |
| 5,129,169 | 7/1992 | Aubichon . |
| 5,253,449 | 10/1993 | Webb et al. . |

*Primary Examiner*—Robert E. Pezzuto
*Attorney, Agent, or Firm*—Donald J. Lecher

[57] ABSTRACT

A bucket converter for providing improved excavation versatility that couples with and attaches to an excavation. The bucket converter comprises a volume increasing frame coupled and semi-fixedly attached to an excavation bucket for increasing the volumetric capacity of the excavation bucket. An orienting projection from a lower portion of the frame holds the coupling element of the frame at a height above a surface when the bucket converter is detached from the excavation bucket and is supported on the surface by the orienting projection and a lowermost portion of the frame. The height at which the coupling portion is held by the orienting projection enables engagement of the coupling portion with a cooperative coupling element on the excavation bucket without the need for any initial manual assistance. Additionally, the bucket converter also provides additional functionality to an excavation bucket by providing an alternative cutting edge to the excavation bucket to which it is attached, thereby eliminating the need for multiple buckets at an excavation site.

30 Claims, 5 Drawing Sheets

BUCKET CONVERTER FOR AN EXCAVATION BUCKET

BACKGROUND OF THE INVENTION

1. Field of Invention

The present invention pertains to the field of art encompassing earth-moving machines and more particularly to attachments for excavation buckets. The present invention relates to a detachable bucket converter that is initially coupled to an excavation bucket without the need for any manual assistance. Additionally, the bucket converter provides improved excavation versatility by increasing the volumetric capacity of the excavation bucket and providing an alternative cutting edge with respect to the excavation bucket, thereby eliminating the need for additional buckets with alternative cutting edges during operation at a work site.

2. General Background and Discussion of Prior Art

In the past, volume increasing implements attached to excavation buckets have been fastened directly to the bucket with a plurality of manually connected fasteners. This attachment method creates a labor and time intensive process of installation and detachment of the heavy working implements. As a result of the implements' heavy weight to withstand bending influences under operation, the manual labor of several persons is usually required to position and fasten the implement on the excavation tool.

Examples of what is known in the prior art showing a removable implement for attachment to an excavation bucket with a plurality of manually connected fasteners, are as follows: Wolfe et al., U.S. Pat. No. 3,034,237; Fortier, U.S. Pat. No. 3,362,554; Johnson, U.S. Pat. No. 4,009,529; Stone, U.S. Pat. No. 4,208,814; Jefferson, U.S. Pat. No. 4,704,811; and Webb et al., U.S. Pat. No. 5,253,449.

Additionally, the following prior art shows volume increasing means for excavation buckets and loaders that are non-detachable with respect to the buckets and rotate into and out of position for use: Benno, U.S. Pat. No. 3,092,920; Arnold, U.S. Pat. No. 3,767,070; Arnold, U.S. Pat. No. 3,854,608; Grimes, 3,938,680; Diggs, U.S. Pat. No. 4,051,614; and Campin, U.S. Pat. No. 4,566,844.

Finally, Aubichon, U.S. Pat. No. 5,129,169 teaches a volume increasing side extensions for attachment to a front end loader bucket only for the purpose of pushing material along a planar surface, such as snow. Aubichon differs from the present invention in that the design of the volume increasing wing extensions are sufficient only to push material along the ground and there is no connection mechanism to the loader bucket that allows the volume increasing attachment to operate under the full range of motion and loads typically associated with hydraulically powered earth-moving excavation buckets.

OBJECTS AND ADVANTAGES

It is the principle object of the present invention to provide a detachable converter for an excavation bucket that increases the volumetric capacity of the excavation bucket.

It is a further object of the present invention to provide an improved coupling mechanism for a bucket converter allowing for a method of attachment to an excavation bucket wherein there is no initial need for manual assistance and the final connection may be completed from a remote location.

It is a further object of the present invention to provide a converter for an excavation bucket that functions to change the cutting edge of the excavation bucket to which it is attached, thereby eliminating the need for the transportation of multiple buckets to an excavation site.

SUMMARY OF THE PRESENT INVENTION

Herein is disclosed and claimed a bucket converter for mounting to an excavation bucket of universal applicability (the like of which includes, but is not limited to, track loaders, backhoes, excavators, wheel loaders and skid steer loaders). The bucket converter comprises volume increasing means adapted increase the volumetric capacity of the excavation bucket mounted thereupon, coupling and attachment means integral with the volume increasing means for affixing to an excavation bucket, and orienting means for holding the coupling means at a sufficient height above a surface when the bucket converter is detached from the excavation bucket and supported on the surface by the orienting means and said lowermost portion of the volume increasing means. The height that the coupling means is held by the orienting means enables engagement of the coupling means with a cooperative coupling means on the excavation bucket. This enables the initial attachment of the bucket converter to an excavation bucket without any initial need for manual assistance.

The bucket converter also provides additional functionality for the excavation bucket by providing an alternative cutting edge to the cutting edge of the excavation bucket to which it is attached, thereby eliminating the need for multiple buckets with alternative cutting edges at an excavation site.

DETAILED DESCRIPTION OF THE PREFERRED EMBODIMENT

Figure 1:
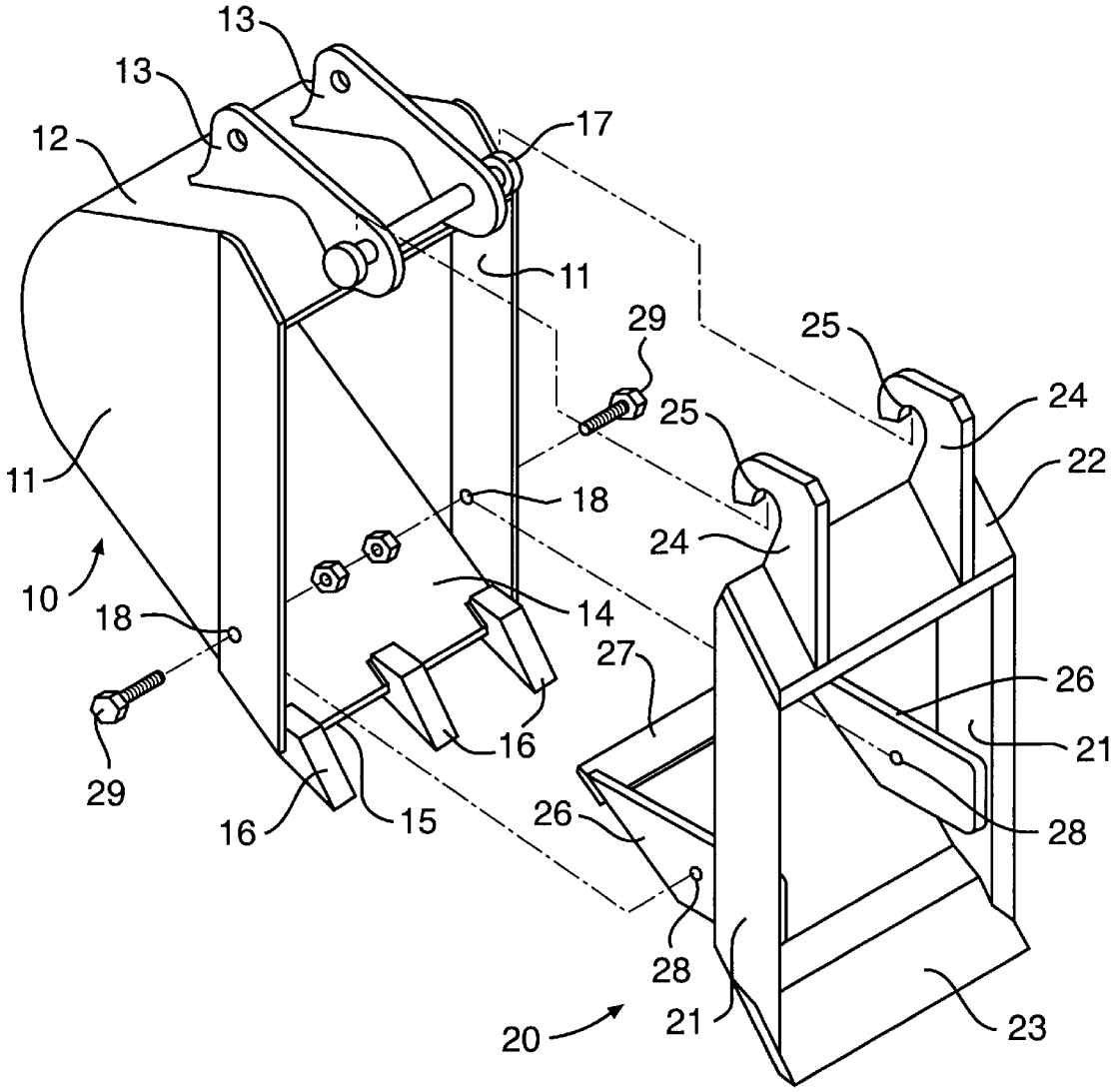
FIG. 1 Front perspective view of the excavation bucket and the bucket converter.
Figure 2:
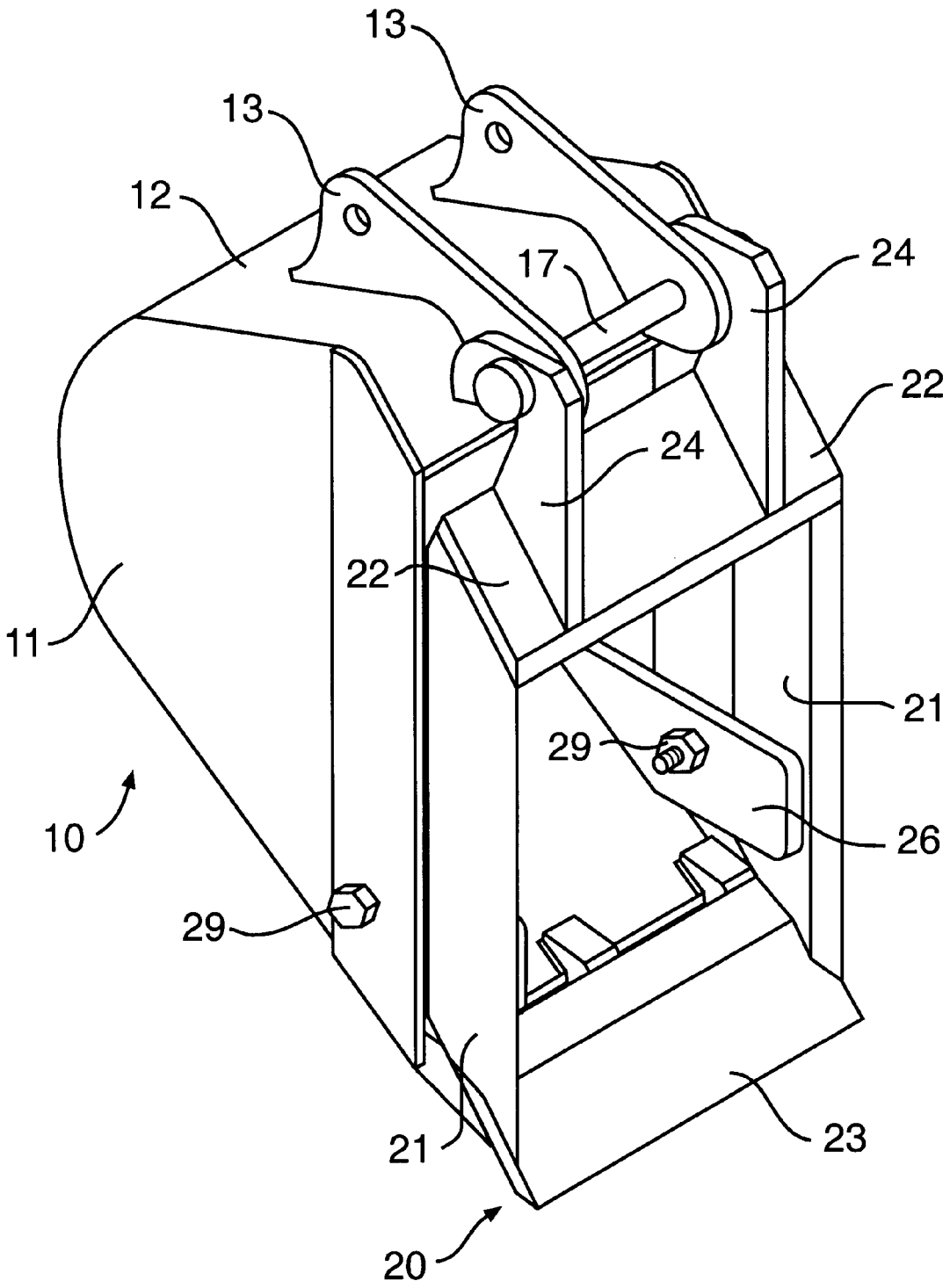
FIG. 2 Front perspective view of the bucket converter mounted upon and attached to the excavation bucket.

FIGS. 1 & 2. DESCRIPTION OF A BUCKET CONVERTER FOR ATTACHMENT TO AN EXCAVATION BUCKET.

FIG. 1 shows an excavation bucket 10 having dual sides 11, a top portion 12 to which mounting flanges 13 are secured for connection to a hydraulic boom arm assembly (not shown in FIG. 1), and a lower portion 14 with a forward facing cutting edge 15 to which are attached spade teeth 16. Wrist pins (like ref. no. 17) are located in each aperture of mounting flanges 13 for connecting the excavation bucket to a hydraulic boom arm assembly.

A bucket converter 20 has a volume increasing frame comprising two side members 21, a top member 22, and a flat bottom cutting edge member 23. Attached to the top member 22 are upwardly projecting coupling arms 24 each having coupling hooks 25 (as shown in FIG. 1) with a semi-circular bearing surface. Attached to each lower portion of the volume increasing frame side members are orienting projections 26, having a transverse member 27 spanning between the distal end portions of each orienting projections 26.

FIG. 2 shows the bucket converter 20 mounted upon the excavation bucket 10. This mounting is accomplished by first coupling the coupling hooks 25 of the coupling arms 24 with the forward wrist pin 17 in the mounting flanges. After this coupling engagement is accomplished, the bucket converter 20 is rotated about the common axes of the wrist pin 17 and the semi-circular bearing surfaces of the coupling hooks 25 to bring the lower portion of the bucket converter into contact with the front edge of the excavation bucket 10. When the volume increasing frame members contact the forward edge of the excavation bucket, the side members 21 align in the same plane as the excavation bucket sides 11, and the top member 22 aligns in the same plane as the excavation bucket top portion 12, thereby functionally increasing the working volume of the excavation bucket. Fasteners are then inserted through the excavation bucket 10 attachment holes 18 and into bucket converter 20 attachment holes 28 to fully secure the bucket converter 20 the excavation bucket 10 after its initial coupling. When the attachment is fully secured, the orienting projections 26 mount flush up against the excavator bucket 10 interior side walls 11 and the transverse member 27 mounts flush up against the lower portion 14 of the excavator bucket 10 to minimize any obstruction to the interior volume of the excavator bucket 10 while in operation.

Attachment holes 28 in the orienting projections 26 of the bucket converter 20 are then aligned with cooperative attachment holes 18 in the excavation bucket to be connected with a fastener. This connection can be accomplished by manually inserting removable bolt and nut fasteners 29 into attachment holes 18 in the excavation bucket and then attachment holes 28 of the bucket converter. Additionally, an alternative connection mechanism would implement a remotely actuated fastener or latch in place of the manually connected bolt and nut fasteners 29, thus enabling the excavation bucket 10 and the bucket converter 20 to be remotely connected and disconnected without the need for any manual assistance. A remotely actuated connection system as described would greatly reduce the time and effort to attach and detach the bucket converter to an excavation bucket and could be accomplished where the operator of the excavation equipment is located.

The bottom cutting edge member 23 lays over the top of the excavation bucket forward cutting edge 15 and spaded teeth 16, thereby replacing the cutting edge of the excavation bucket 10 with that of the bucket converter 20. This transformation of the cutting edge eliminates the need to purchase and transport additional excavation buckets having different cutting edge configurations to an excavation site. Additionally, bottom cutting edge 23 of the bucket converter is able to be replaced with interchangeable cutting implements that could be fastened to or replace in total the cutting edge 23, thereby extending the useful service life of the bucket converter and lending to its increased excavation versatility.

Figure 3:
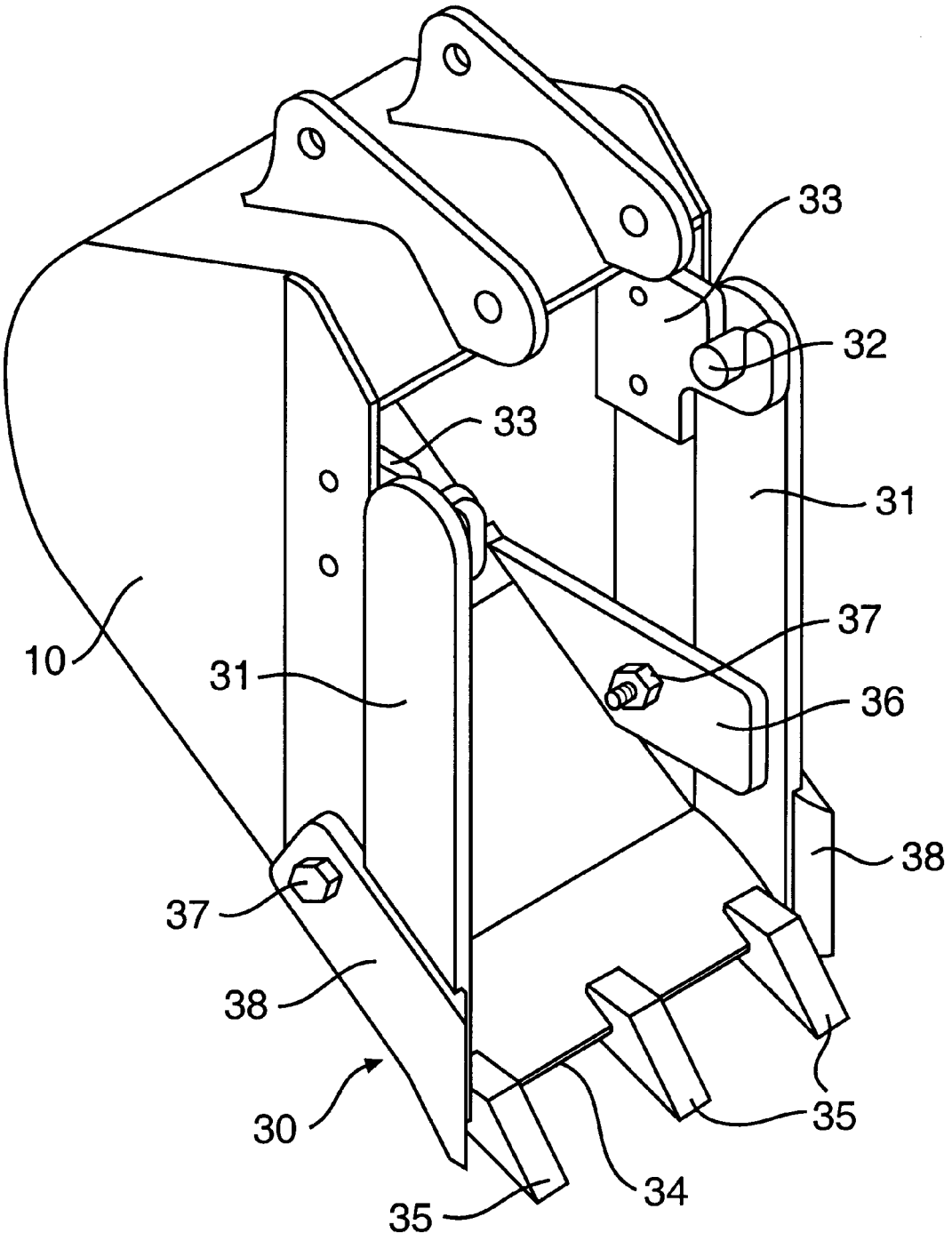
FIG. 3 Front perspective view of an alternative embodiment of the bucket converter with side cutters attached in an alternative manner to an excavation bucket.

FIG. 3. DESCRIPTION OF AN ALTERNATIVE EMBODIMENT OF A BUCKET CONVERTER FOR ATTACHMENT TO AN EXCAVATION BUCKET.

FIG. 3 shows an alternative embodiment to the bucket converter of FIGS. 1 & 2. Bucket converter 30 has arm members 31 similar in function to the side members 21 of the previous embodiment. However, the coupling mechanism is replaced with a circular coupling stubs 32 extending inwardly from the distal end portions of arm members 31 for engaging bucket mounted flanges 33 on the excavation bucket 10. This configuration allows for the bucket converter to be mounted on excavation buckets where the geometry of the wrist pin 17 relative to the coupling arms 24 of the first embodiment of FIGS. 1 & 2 would be unfeasible.

The lower cutting edge 34 of the bucket converter 30 has spaded teeth 35 which allows for improved excavation versatility when mounting the bucket converter 30 upon an excavation bucket with a different cutting edge, e.g., a flat cutting edge.

Attachment holes (not shown) in the orienting projections 36 of the bucket converter 30 are then aligned with cooperative attachment holes (not shown) in the excavation bucket to be connected either manually or automatically, as stated above, with a fastener assembly 37 or latching mechanism.

Side cutters 38 are mounted on the lower portion of arm members 31. As well known in the art, side cutters 38 are implemented to give improved cutting ability at high wear points of the cutting surface of excavation buckets and are usually designed to be replaceable. However, the present invention additionally enables the bucket converter side cutters 38 to provide connecting features to the excavation bucket 10 through holes in the side cutter 38 (through which is connected via fastener assembly 37 as shown) which align with attachment holes in the excavator bucket (similar to ref. no. 18 in FIG. 1) and attachment holes in the orienting projection 26 (similar to ref. no. 28 in FIG. 1). Additionally, when the bucket converter side cutter 38 is of sufficient length and resting on a surface, it is able to orient the bucket converter's coupling features with respect to the resting surface thereby enabling coupling with the cooperative coupling features on the excavation bucket. The side cutters 38 in this capacity can either supplement or replace the orienting projections 36 with their related connecting and orienting features.

Additionally, the side cutters 38 of FIG. 3 can also be used in combination with the bucket converter of FIGS. 1 & 2 to either replace or supplement the orienting projections 26.

FIGS. 4A–4D. DESCRIPTION OF ATTACHMENT SEQUENCE OF A BUCKET CONVERTER TO AN EXCAVATION BUCKET WITHOUT MANUAL ASSISTANCE.

Figure 4B:
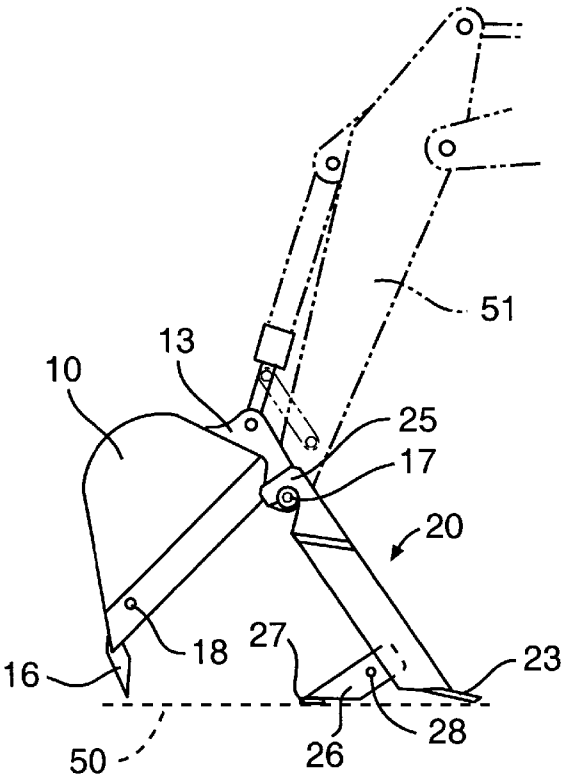
FIG. 4B Side view of the second attachment sequence step wherein the bucket coupling mechanism is engaged with the upper coupling portion of the bucket converter.
Figure 4A:
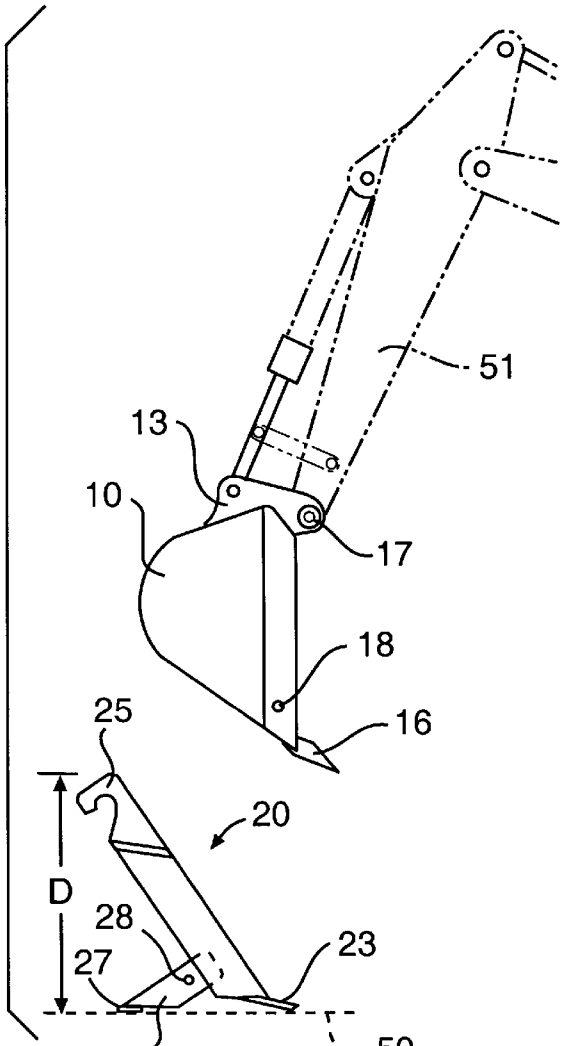
FIG. 4A Side view of the first attachmnent sequence step wherein the bucket converter is resting on ground.

FIGS. 4A–D illustrate the attachment sequence of the bucket converter 20 of FIGS. 1–2 to an excavation bucket 10. FIG. 4A illustrates implement adapter 20 resting on a horizontal surface 50 supported generally by the orienting projections 26 and the lower portion of the bottom cutting edge member 23. Transverse member 27 spanning between the distal end portions of each orienting projections 26 further enables support of bucket converter 20 at a predetermined angle with respect to surface 50 when resting on an uneven surface. Either orienting projections 26 alone, or in combination with the transverse member 27 enable the coupling hooks 25 of the bucket converter 20 to be oriented at a certain distance D above the surface 50 when the bucket converter 20 rests on the surface 50. Excavation bucket 10 is prepared for engagement with the bucket converter 20 with the wrist pin 17 mounted on the front portion of the mounting flange 13 of excavation bucket 10. Once the excavation bucket 10 is pivotally connected to the excavation boom arm 51, the wrist pin 17 can be aligned with respect to the coupling hooks 25 of the implement adapter 20.

FIG. 4B illustrates the rearwardly tilting position of the excavation bucket 10 as lowered by the boom arm 51 at the moment of coupling engagement between the coupling hooks 25 and the wrist pin 17. The distance D which coupling hooks 25 are parked above the surface 50, allows the boom arm 51 to manipulate the excavation bucket 10 and its attached wrist pin 17 into engagement with the semi-circular bearing portions of the coupling hooks 25 without the bucket teeth 16 or any other portion of the forward lowermost portion of the excavation bucket 10 interfering with the surface 50.

Once coupling hooks 25 are rotatably secured to the wrist pin 17, excavator boom arm 51 is raised upward causing the bucket converter 20 to rotate simultaneously about the axis of the wrist pin 17 and about a longitudinal axis created by the lowermost portion of bucket converter 20 bearing along the lower cutting edge 23. After excavator boom arm 51 has raised the bucket converter 20 completely off the surface 50, (FIG. 4C), the hydraulic actuators of the boom arm 51 rotate the excavation bucket 10 around the wrist pin 17 to move the forward open edge of excavation bucket 10 toward the bucket converter 20. In this manner, the bucket converter 20 is initially coupled to the excavation bucket 10 without the need for any manual assistance.

Figure 4D:
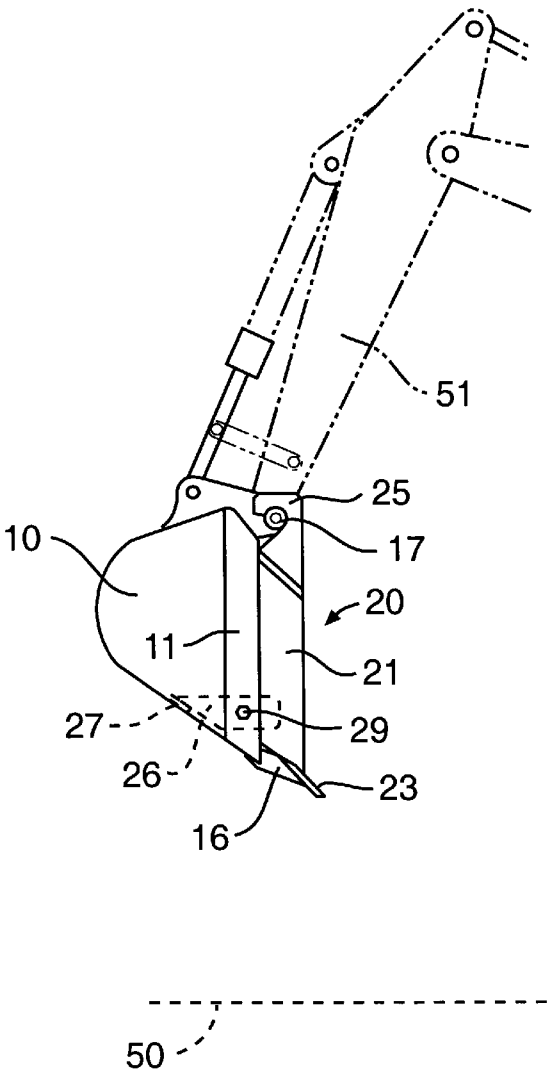
FIG. 4D Side view of the fourth and final attachment sequence step wherein the lower portion of the bucket converter is positioned to enable fastening to the excavation bucket.
Figure 4C:
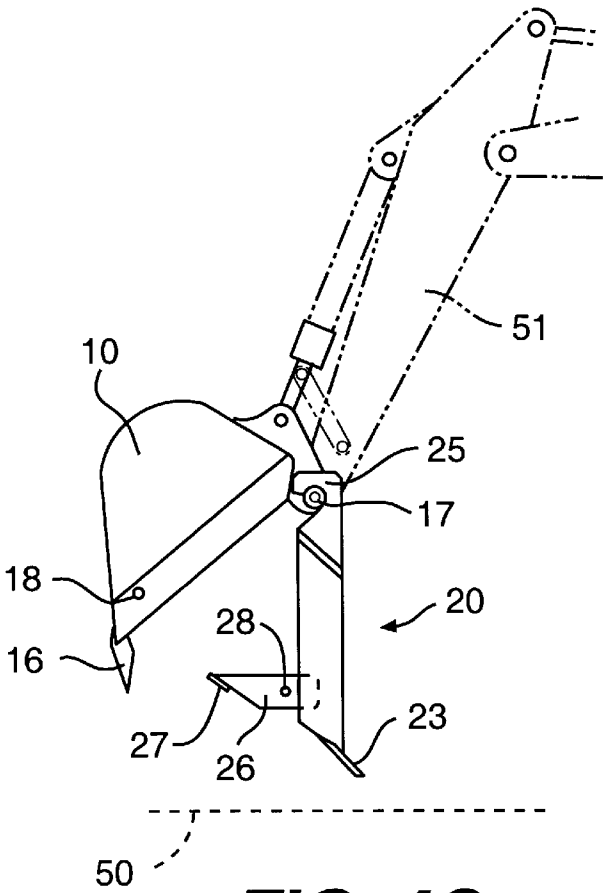
FIG. 4C Side view of the third attachment sequence step wherein the bucket converter is lifted off the ground while pivotally coupled to the bucket.

FIG. 4D illustrates the final securing attachment of the bucket converter 20 to excavation bucket 10. The excavation bucket 10 is then rotated about wrist pin 17 to a position where the forward side cutting edges 11 of excavation bucket 10 engage rear portions of the bucket converter 20, i.e., specifically, the rear portions of side members 21 and the lower cutting edge 23. Once in this position, fastener assemblies 29 can be manually or automatically connected through the co-axial fastener holes 28 of orienting projections 26 of the bucket converter 20 through side connecting holes 18 of the excavation bucket 10, thus fully securing the bucket converter 20 to the excavation bucket 10. Once in this fully connect state, the bucket converter can be fully manipulated by the hydraulic boom arm 51 into any suitable working position while attached to and supplementing the volumetric capacity and the lower cutting edge of the excavator bucket 10.

Because many varying and different embodiments may be made within the scope of the inventive concept herein taught, and because many modifications may be made in the the embodiments herein detailed in accordance with the descriptive requirement of the law, it is to be understood that the details herein are to be interpreted as illustrative and not in a limiting sense.

What is claimed as the invention is:

1. A converter for an excavation bucket comprising:

volume increasing means adapted to increase the volumetric capacity of said excavation bucket;

coupling means attached to a top portion of said volume increasing means, said coupling means adapted for coupling to a cooperative coupling means on said excavation bucket;

connection means attached to a lower portion of said volume increasing means adapted for positively connecting to said excavation bucket;

orienting means extending from a lower portion of said volume increasing means for orienting said coupling means at a sufficient height above a surface when said converter is supported on said surface by said orienting means and said lower portion of said volume increasing means, wherein said sufficient height is adapted to enable engagement of said coupling means with said cooperative coupling means on said excavation bucket with no manual assistance.

2. A converter of claim 1, wherein said connecting means further comprises fastening means adapted to semi-fixedly fasten said connecting means to said excavation bucket.

3. A converter of claim 2, wherein said fastening means comprises a fastening assembly fastened through a hole in said connecting means adapted to fasten to a corresponding hole in said excavation bucket.

4. A converter of claim 2, wherein said fastening means comprises a remotely actuated mechanism adapted for fastening said connecting means to said excavation bucket.

5. A converter in accordance with claim 1, wherein said volume increasing means further comprises two arms with said coupling means having a semi-circular bearing surface on the upper distal ends of each of said two arms adapted for pivotal coupling with a mating circular element of said cooperative coupling means.

6. A converter in accordance with claim 1, wherein said coupling means further comprises a circular coupling element fixably attached to an upper end portion of said frame means adapted for pivotal coupling with at least one semi-circular bearing surface on said cooperative coupling means.

7. A converter in accordance with claim 1, wherein said orienting means is the distal end of said connecting means.

8. A converter in accordance with claim 1, wherein said orienting means further comprises a parking foot projecting orthogonal to the longitudinal axis of said orienting means.

9. A converter in accordance with claim 1, wherein said volume increasing means comprises at least two sides in planar alignment with and projecting in a forward direction from the forward opening edges of said excavation bucket.

10. A converter in accordance with claim 1, wherein said volume increasing means comprises cutting means located on a forward edge of said volume increasing means on a lower portion of said volume increasing means opposite from said coupling means.

11. A converter in accordance with claim 10, wherein said cutting means further comprises a plurality of cutting edges.

12. A converter in accordance with claim 10, wherein said cutting means further comprises a flat cutting edge.

13. A converter in accordance with claim 1, wherein side cutters are attached to lower edges of said volume increasing means.

14. A converter in accordance with claim 13, wherein said side cutters comprises said connecting means.

15. A converter in accordance with claim 13, wherein said side cutters comprises said orienting means.

16. A converter for an excavation bucket comprising:

volume increasing means adapted to increase the volumetric capacity of said excavation bucket;

coupling means attached to a top portion of said volume increasing means, said coupling means adapted for coupling to a cooperative coupling means on said excavation bucket;

connection means attached to a lower portion of said volume increasing means adapted for positively connecting to said excavation bucket;

cutting means located on a forward lower edge portion of said volume increasing means opposite from said coupling means; and orienting means for orienting said coupling means at a sufficient height above a surface when said converter is supported on said surface, wherein said sufficient height is adapted to enable engagement of said coupling means with said cooperative coupling means on said excavation bucket with no manual assistance.

17. A converter of claim 16, wherein said connecting means further comprises fastening means adapted to semi-fixedly fasten said connecting means to said excavation bucket.

18. A converter of claim 17, wherein said fastening means comprises a fastening assembly fastened through a hole in said connecting means adapted to fasten to a corresponding hole in said excavation bucket.

19. A converter of claim 17, wherein said fastening means comprises a remotely actuated mechanism adapted for fastening said connecting means to said excavation bucket.

20. A converter in accordance with claim 16, wherein said volume increasing means further comprises two arms with said coupling means having a semi-circular bearing surface on the upper distal ends of each of said two arms adapted for pivotal coupling with a mating circular element of said cooperative coupling means.

21. A converter in accordance with claim 16, wherein said coupling means further comprises a circular coupling element fixably attached to an upper end portion of said frame means adapted for pivotal coupling with at least one semi-circular bearing surface on said cooperative coupling means.

22. A converter in accordance with claim 16, wherein said orienting means is the distal end of said connecting means.

23. A converter in accordance with claim 16, wherein said orienting means further comprises a parking foot projecting orthogonal to the longitudinal axis of said orienting means.

24. A converter in accordance with claim 16, wherein said volume increasing means comprises at least two sides in planar alignment with and projecting in a forward direction from the forward opening edges of said excavation bucket.

25. A converter in accordance with claim 16, wherein said cutting means further comprises a plurality of cutting edges.

26. A converter in accordance with claim 16, wherein said cutting means further comprises a flat cutting edge.

27. A converter in accordance with claim 16, wherein side cutters are attached to lower edges of said volume increasing means.

28. A converter in accordance with claim 27, wherein said side cutters comprises said connecting means.

29. A converter in accordance with claim 27, wherein said side cutters comprises said orienting means.

30. A method of machine mounting an converter upon an excavation bucket, said converter characterized by volume increasing means for increasing the volumetric capacity of an excavation bucket, coupling means adapted for coupling to a cooperative coupling means on said excavation bucket, connection means adapted for positively connecting to said excavation bucket, and orienting means adapted to enable engagement of said coupling means with said cooperative coupling means on said excavation bucket with no manual assistance, the steps including:

resting said converter upon a surface so that said orienting means and a lower portion of said volume increasing means contact said surface;

subjecting said coupling means to an upward moving cooperative coupling means of said excavation bucket;

subjecting said converter to pivotal upward displacement about an axis collinear with said lower portion of said converter simultaneous with and dependent upon the continuing engagement of said couplings means with said cooperative coupling means of said excavation bucket; and rotating said connecting means about said axis of said coupling means to enable connection of said connecting means to said excavation bucket;

wherein said converter is securely mounted upon said excavation bucket for all ranges of motion upon said excavation bucket.

* * * * *